US006923863B1

(12) United States Patent
Baker et al.

(10) Patent No.: US 6,923,863 B1
(45) Date of Patent: Aug. 2, 2005

(54) APPARATUS AND METHOD FOR BOWLING LANE MAINTENANCE

(75) Inventors: Adam P. Baker, Mechanicsville, VA (US); Gary J. Ford, Chesterfield, VA (US); Mark D. Kilpatrick, Richmond, VA (US); Matthew E Popielarz, Aylett, VA (US); G. Joe Burroughs, Quinton, VA (US)

(73) Assignee: AMF Bowling Products Inc., Mechanicsville, VA (US)

( * ) Notice: Subject to any disclaimer, the term of this patent is extended or adjusted under 35 U.S.C. 154(b) by 0 days.

(21) Appl. No.: 10/461,330

(22) Filed: Jun. 16, 2003

(51) Int. Cl.[7] ..... B05C 1/08
(52) U.S. Cl. ..... 118/207; 118/262; 118/264; 118/268; 15/50.3; 15/98; 15/320
(58) Field of Search ..... 118/207, 244, 262, 118/264, 268; 15/50.3, 4, 98, 320

(56) References Cited

U.S. PATENT DOCUMENTS

| | | | | |
|---|---|---|---|---|
| 2,087,488 A | | 7/1937 | Stanley | |
| 2,909,150 A | | 10/1959 | Ungerer | |
| 3,216,036 A | | 11/1965 | Rockwood et al. | |
| 3,216,037 A | | 11/1965 | Stevens et al. | |
| 3,422,758 A | * | 1/1969 | Brewster | 101/425 |
| 3,811,407 A | | 5/1974 | Lupkas et al. | |
| 4,562,610 A | | 1/1986 | Davis et al. | |
| 4,920,604 A | | 5/1990 | Ingermann et al. | |
| 4,959,884 A | | 10/1990 | Ingermann et al. | |
| 4,962,565 A | | 10/1990 | Ingermann et al. | |
| 4,980,815 A | | 12/1990 | Davis | |
| 5,181,290 A | | 1/1993 | Davis et al. | |
| 5,181,716 A | | 1/1993 | Stephens | |
| 5,185,901 A | | 2/1993 | Davis et al. | |
| 5,206,054 A | | 4/1993 | Schultz | |
| 5,243,728 A | | 9/1993 | Smith et al. | |
| 5,322,476 A | | 6/1994 | Wortman | |
| 5,455,977 A | | 10/1995 | Caffrey et al. | |
| 5,650,012 A | | 7/1997 | Davis | |
| 5,651,627 A | | 7/1997 | Dowzall et al. | |
| 5,729,855 A | | 3/1998 | Davis | |
| 5,753,043 A | | 5/1998 | Davis | |
| 5,935,333 A | | 8/1999 | Davis | |
| 6,361,602 B1 | | 3/2002 | Hahn | |
| 6,383,290 B1 | | 5/2002 | Davis et al. | |

OTHER PUBLICATIONS

Foamex International Inc. marketing pamphlet, publication date unknown.

Lane Masters, Inc., "Legends Extreme Wick Pads," found at www.lanemasters.com/LMWebSite/Products/oilExtremeWicks.html, one page, printed Oct. 9, 2003.

Lane Masters, Inc., "Recommended Conditioning Procedures for Exceptional Lane Conditions," found at http://www.lanemasters.com/LMWebsite/Procedures/pfShuttle2000.html, p. 1 and 9-11, printed Oct. 9, 2003.

* cited by examiner

*Primary Examiner*—Laura Edwards
(74) *Attorney, Agent, or Firm*—Finnegan, Henderson, Farabow, Garrett & Dunner, LLP

(57) ABSTRACT

A bowling lane maintenance apparatus includes a transfer roller and a dressing oil tank configured to contain dressing oil. A wick is configured to pass dressing oil from the tank to the transfer roller. A buffer brush is configured to receive dressing oil from the transfer roller and spread the dressing oil on a bowling lane. The wick may comprise a foam material having a first region having a first capillarity and a second region having a second capillarity differing from the first capillarity. The wick may also be maintained in contact with the transfer roller.

24 Claims, 10 Drawing Sheets

APPARATUS AND METHOD FOR BOWLING LANE MAINTENANCE

DESCRIPTION OF THE INVENTION

1. Field of the Invention

This invention relates to bowling lane maintenance. More particularly, this invention relates to an apparatus and method for dressing a bowling lane surface.

2. Background of the Invention

The American Bowling Congress, the regulatory body overseeing bowling sport and competition, requires that dressing oil on a bowling lane meet issued specifications regarding oil thickness. During certain "league" and "sport" sanctioned events, these specifications require that dressing oil be applied to the bowling lane in a manner that gives the oil a specified profile across the lane. The required profile includes a thicker layer of oil at the center portion of the lane, with the oil thickness tapering toward the gutters on each side of the lane, within established limits. To comply with the specifications, maintenance must be performed and a new layer of oil must be applied to the bowling lane on a regular basis.

A typical lane dressing apparatus may have as many as six separate oil tanks associated with cotton or fibrous felt wicks. The wicks are each independently moved by a solenoid to bring the wicks into and out of contact with oil application components. The amount of oil applied to the lane is controlled by the time period that the wick is in contact with these components. By independently moving the wicks, a wick associated with one region of the lane can be held in contact with the application components longer than a wick associated with another region of the lane. Accordingly, to create an oil profile within the American Bowling Congress specifications, wicks associated with the center of the lane are held in contact for longer periods of time than wicks associated with the edges of the lane. So doing provides an oil profile on the lane having a thicker layer of oil in the center portion than on the edges.

However, maintaining six separate tanks and wicks in a single apparatus may be cumbersome, especially when each tank must be separately filled with oil. Further, the six separate tanks and solenoids greatly add to the overall cost of an apparatus. Additionally, programming a controller to operate the movement of six wicks to provide a desired oil profile is tedious. And each time a different profile is desired, the controller must be reprogrammed to activate and deactivate the solenoids at different rates.

An additional problem associated with conventional apparatuses is the consistency of the wicks. The wicks are manufactured of matted cotton or fibrous felt, and provide an inconsistent flow pattern, even in the same piece. Accordingly, creating an oil profile that complies with the specifications set by the American Bowling Congress is difficult and cumbersome.

Accordingly, it would be desirable to at least partially overcome one or more of the disadvantages of the related art.

SUMMARY OF A FEW ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

As embodied and broadly described herein, an aspect of the invention includes a bowling lane maintenance apparatus. The apparatus may include a transfer roller and a dressing oil tank configured to contain dressing oil. A wick may be configured to pass dressing oil from the tank to the transfer roller. A buffer brush may be configured to receive dressing oil from the transfer roller and spread the dressing oil on a bowling lane.

In one aspect, the wick may be comprised of foam material comprising a first region having a first capillarity and a second region having a second capillarity differing from the first capillarity. The foam material, may comprise, for example, at least one of a polyester urethane, a reticulated polyester urethane, a non-reticulated polyester urethane, a non-reticulated polyether, and a reticulated polyether.

In another aspect, the apparatus may be configured such that the wick is maintained in contact with the transfer roller. As used herein, the phrase, "maintained in contact with" (or "maintaining in contact with") the transfer roller refers to an arrangement where the wick remains in contact with the transfer roller continuously while dressing oil is being applied to a bowling lane undergoing maintenance. Such an arrangement differs from the conventional arrangements where solenoids and/or other movement controlling structures are used to move one or more wicks in and out of contact with one or more oil application components in order to control the amount of oil being applied. In one example, a spring may be used to bias the wick so that it is maintained in contact with the transfer roller. Many alternative configurations with or without one or more springs are also possible.

In another aspect, the apparatus may be configured with at least one dressing oil tank and at least two wicks may be configured to pass dressing oil from the at least one dressing oil tank to the transfer roller. The wicks may have a differing capillarity. In some examples, the wicks may have designations representing their capillarity. For example, the designation may be a color representing their capillarity.

In another aspect, the wicks may be configured to pass dressing oil onto the transfer roller so as to provide a desired dressing oil profile on the bowling lane. Further, the wicks may each be associated with a different dressing oil tank.

In another aspect, the maintenance apparatus may include a cleaning assembly configured to apply cleaner to the bowling lane and remove the cleaner from the lane.

In another aspect, the wick may comprise a first wick and the maintenance apparatus may include a second dressing oil tank. A second wick may be configured to pass dressing oil from the second dressing oil tank to the transfer roller. The second wick may have a capillarity different than the first wick.

In another aspect of the invention, a method of providing maintenance to a bowling lane is provided. The method may include maintaining a wick in contact with a transfer roller so as to pass dressing oil to the transfer roller. The transfer roller may be rotated. A buffer brush in contact with the transfer roller may be rotated to transfer the dressing oil from the transfer roller to the buffer brush, and to spread the dressing oil on a bowling lane.

In another aspect, cleaner may be applied to the bowling lane, and the cleaner may be removed from the bowling lane.

In another aspect, a desired dressing oil profile may be selected to apply to the bowling lane. There may also be a selection of at least one wick having a capillarity different than the capillarity of another wick, and may be arranged to provide a desired dressing oil profile.

In addition to the structural and procedural arrangements set forth above, the invention could include a number of other arrangements such as those explained hereinafter. It is to be understood that both the foregoing general description and the following detailed description are exemplary only.

BRIEF DESCRIPTION OF THE DRAWINGS

The accompanying drawings, which are incorporated in and constitute a part of this specification, illustrate embodiments of the invention and together with the description, serve to explain some principles of the invention.

DESCRIPTION OF EMBODIMENTS

Reference will now be made in detail to exemplary embodiments of the invention, an example of which is illustrated in the accompanying drawings. Wherever possible, the same reference numbers will be used throughout the drawings to refer to the same or like parts.

As described in more detail below, embodiments of the present invention include a wick that passes oil to a transfer roller. In some embodiments, the wick is a foam wick, and may have a capillarity that draws oil from an oil tank in a uniform, consistent flow. Such a consistent flow may obviate the need for an operator to adjust or reprogram a maintenance apparatus in a rather complicated fashion each time a wick is replaced, thereby saving a bowling facility time and money.

In some embodiments, wicks having different capillarities are placed to provide a varied flow rate along the length of the transfer roller. In some examples, the wicks may be held in contact with the transfer roller for an equal length of time, and yet still provide a desired oil profile on the lane. Accordingly, it may be possible to avoid bringing the wicks independently into and out of contact with the transfer roller, thereby possibly eliminating the need for multiple solenoids and actuators. Hence, manufacturing costs may be reduced, and potential maintenance problems with solenoids may be eliminated.

Figure 1:
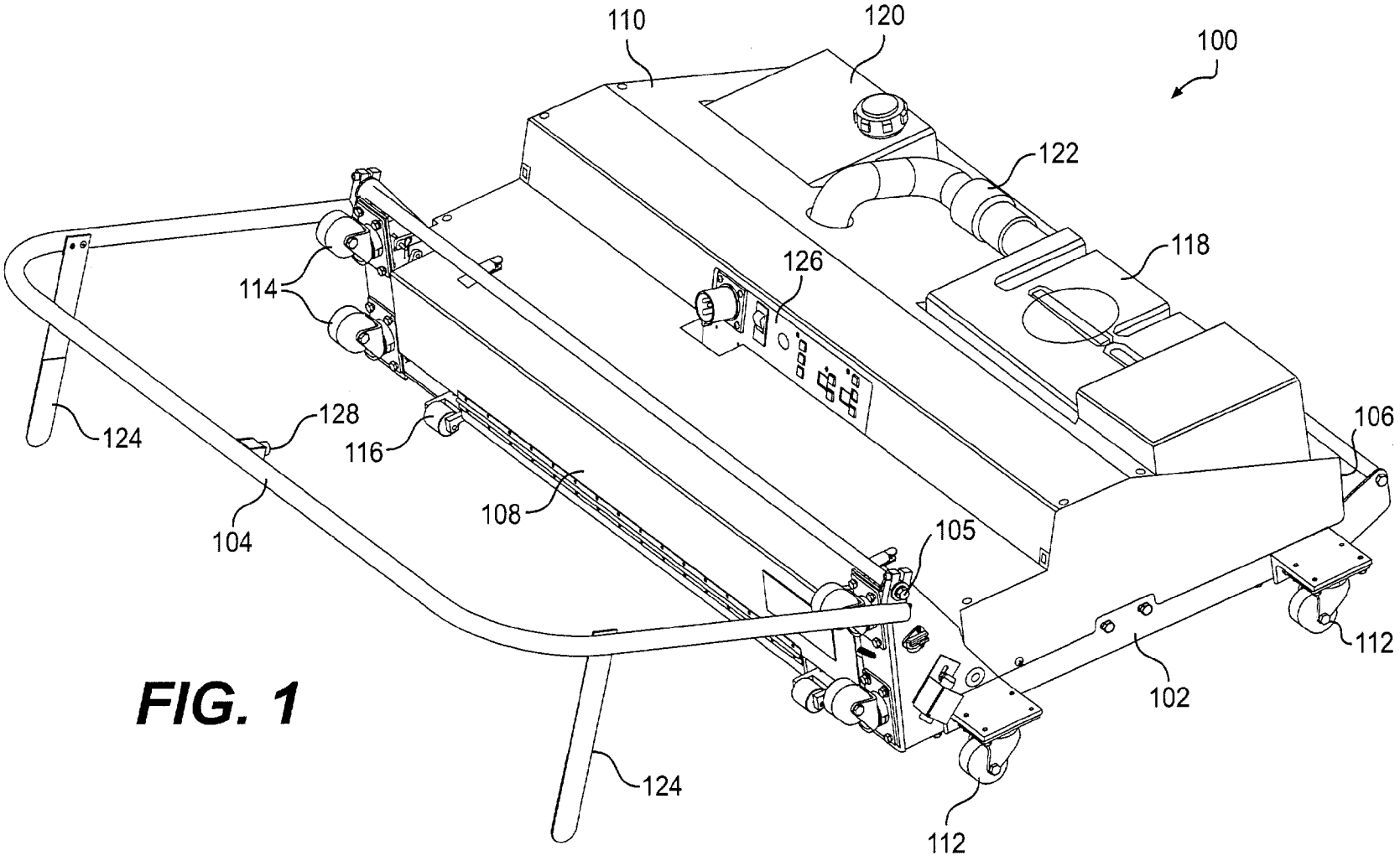
FIG. 1 is an isometric schematic of an exemplary bowling lane maintenance apparatus.

FIG. 1 shows a maintenance apparatus 100 for dressing and cleaning a bowling lane. The maintenance apparatus 100 includes a frame assembly 102, a handle 104, a front end 106, and a rear end 108. The frame assembly 102 includes a hood 110, side casters 112, end casters 114, and idler wheels 116.

The handle 104 extends rearward from the rear end 108 of the apparatus frame 102, and may be raised or lowered about a handle pivot point 105. The handle 104 includes straps 124 that can be used to hold a power cord in place at the side of the apparatus so that it doesn't drag on the lane as the maintenance apparatus 100 moves up and down the lane. The straps 124 may be formed of a hook and loop fastener, or other material, as would be apparent to one skilled in the art. In the exemplary embodiment shown, the handle 104 includes a handle start button 128 centrally located on the handle 104. Using the handle start button, an operator can activate the maintenance apparatus 100 while holding only the handle 104.

The hood 110 may be removably attached to the apparatus frame 102 to cover various components of the maintenance apparatus 100, protecting the components from dust and abuse. It may cover a part or all of the components of the maintenance apparatus 100. In the exemplary embodiment shown, the hood 110 includes openings allowing access to a waste tank 118 and a cleaner tank 120. The hood 110 may be attached to the maintenance apparatus 100 by a hinge or other device so that it may be raised or completely removed to provide access to the components of the maintenance apparatus 100.

The side casters 112 may be fixed to the apparatus frame 102, and may extend on either side of the maintenance apparatus 100. They enable the maintenance apparatus 100 to easily roll over a flat surface, such as an approach area in a bowling alley, but are spaced to hang in a lane gutter when the maintenance apparatus 100 is in place across a bowling lane. End casters 114 support the maintenance apparatus 100 when it is turned so that the rear end 108 is down, giving the maintenance apparatus 100 a smaller footprint than when the maintenance apparatus 100 is in a usable position, making storage efficient.

The idler wheels 116 are located at the rear end 108 of the maintenance apparatus 100, and are aligned on a higher plane than the side casters 112. Accordingly, when moving the maintenance across a surface, such as the approach area, the idler wheels 116 are suspended above the surface, with the side casters 112 supporting the weight of the maintenance apparatus 100. In use, the maintenance apparatus 100 is placed across a bowling lane so that the side casters 112 are suspended in the gutters of the lane. Then, the idler wheels 116 support the maintenance apparatus on the bowling lane.

The waste tank 118 and the cleaner tank 120 are accessible through the hood 110, and may be removably connected to the apparatus frame 102, allowing simple replenishment of cleaner fluid in the cleaner tank 120 and simple disposal of waste from the waste tank 118. As will be described further below, the waste tank 118, the cleaner 120, and a vacuum hose 122 are all used to clean the bowling lane.

A control panel 126 is also provided on the maintenance apparatus 100. The control panel 126 is in electrical communication with components of the maintenance apparatus 100 to power, move, or control the components, as would be apparent to one skilled in the art. The handle start button 128, provided on the handle 104, may be in electrical communication with the control panel 126.

Figure 2:
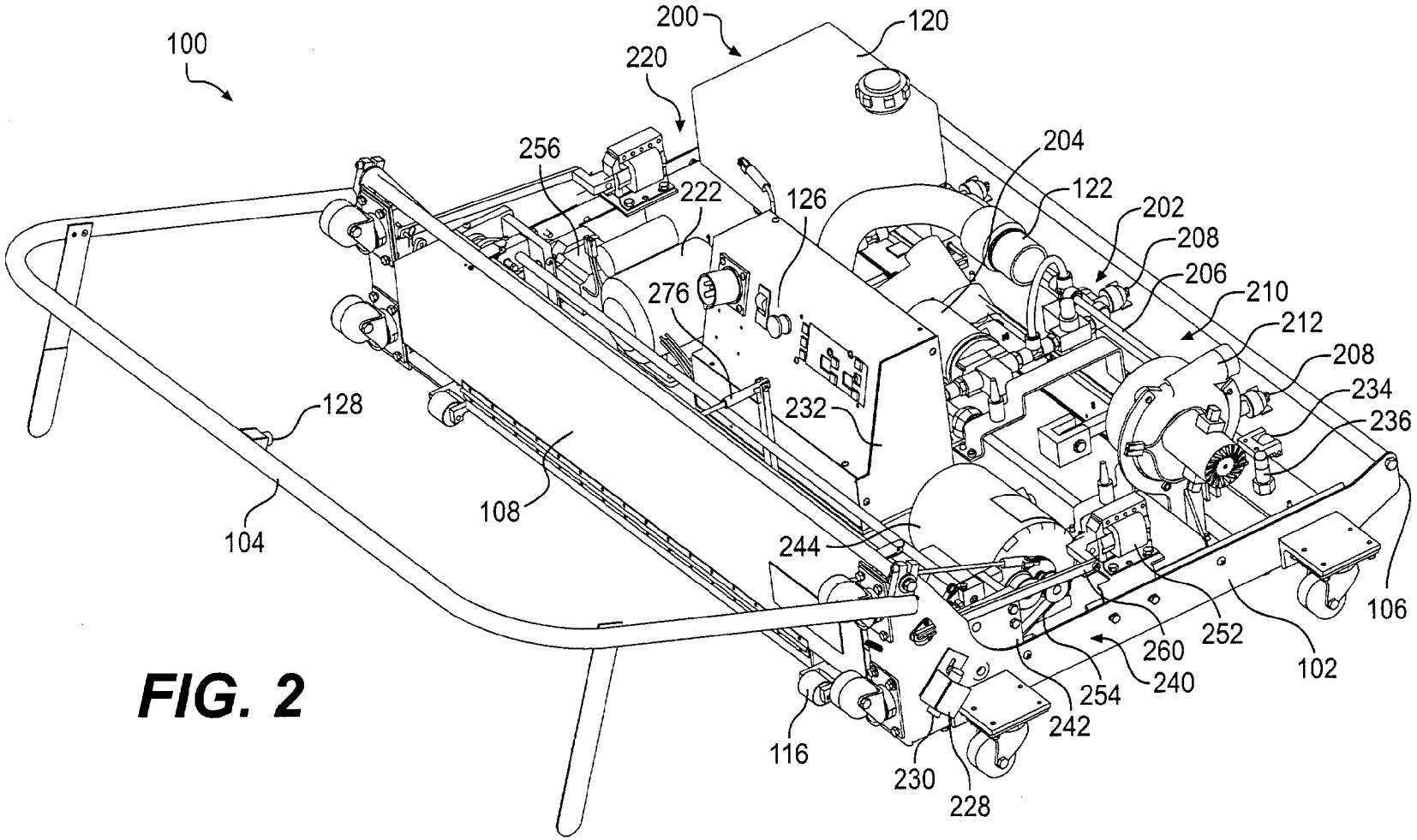
FIG. 2 is a schematic of the exemplary bowling lane maintenance apparatus of FIG. 1 with the hood removed.

FIGS. 2–6 show the components of the maintenance apparatus 100. FIG. 2 shows the maintenance apparatus 100 of FIG. 1 with the hood 110 and the waste tank 118 removed.

Figure 3:
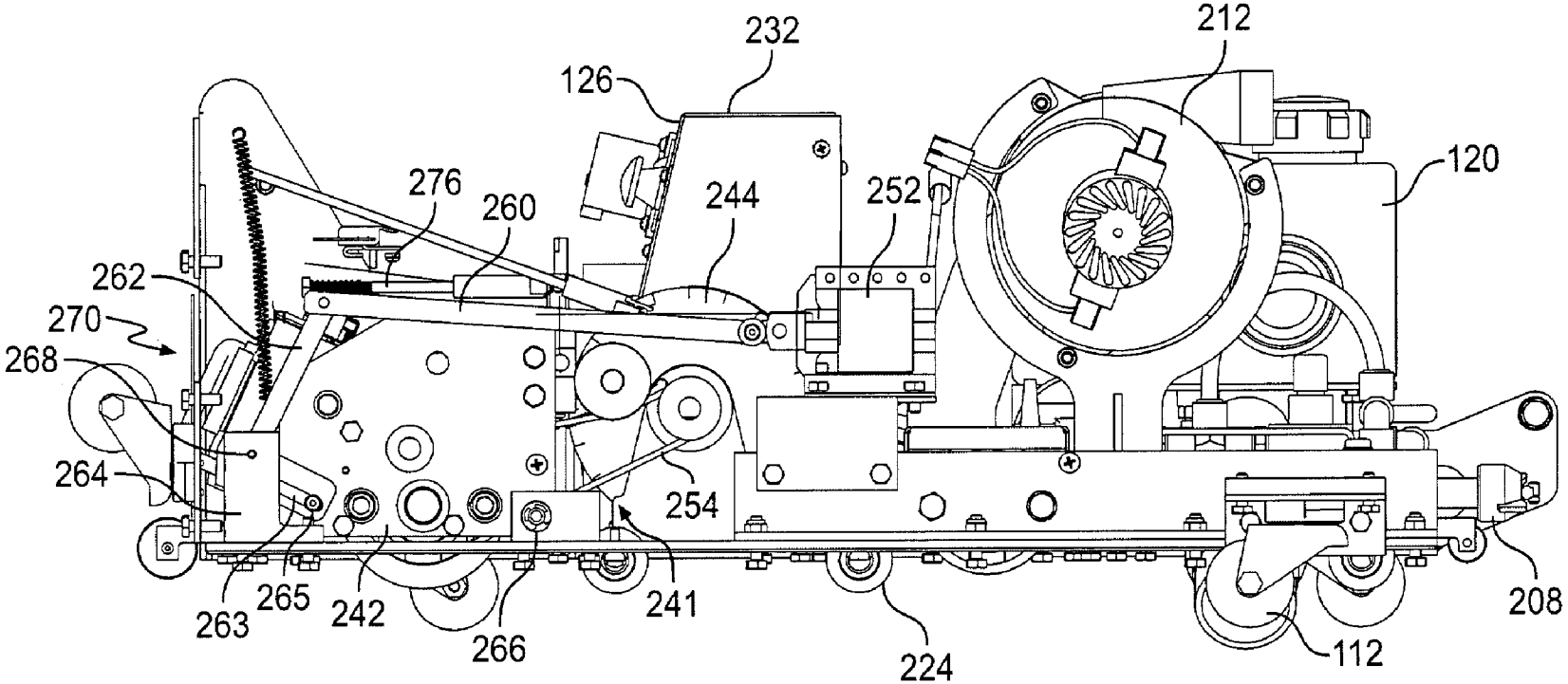
FIG. 3 is a schematic side view of the exemplary bowling lane maintenance apparatus of FIG. 1.
Figure 4:
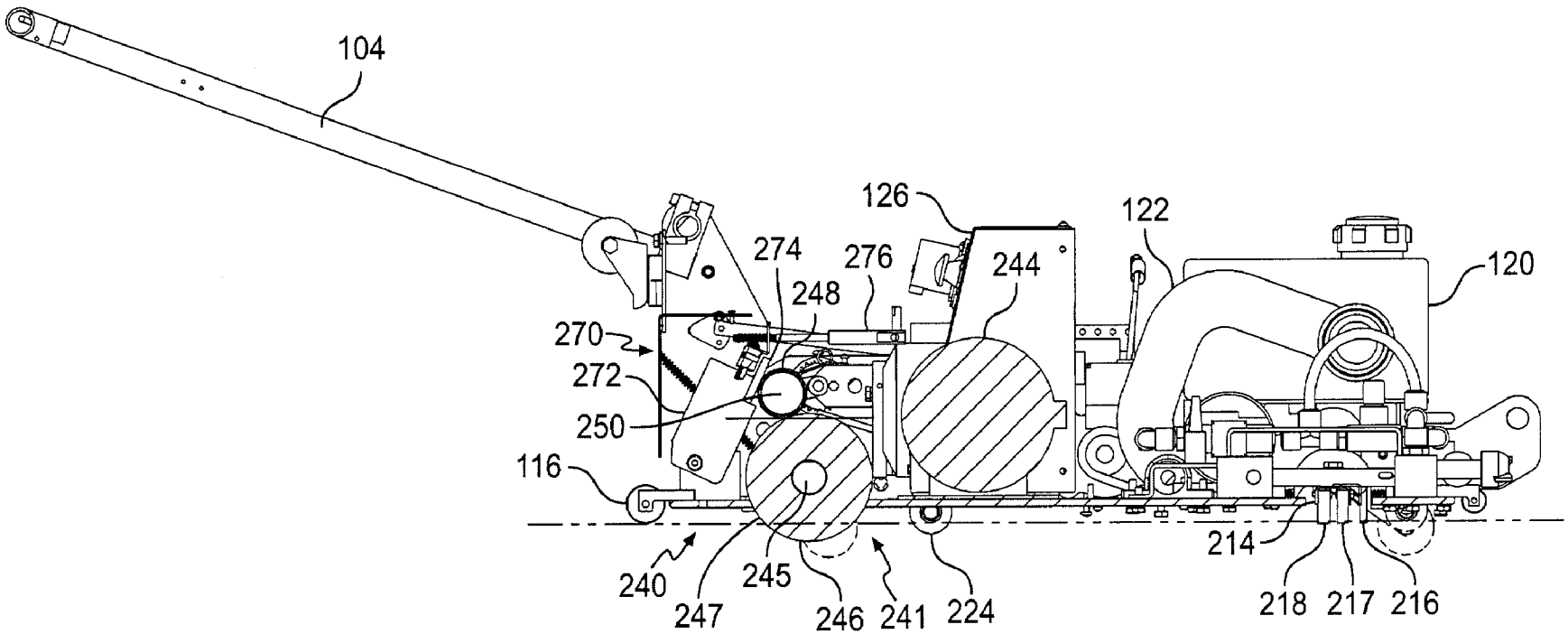
FIG. 4 is a schematic sectional view of the exemplary bowling lane maintenance apparatus of FIG. 1.
Figure 5:
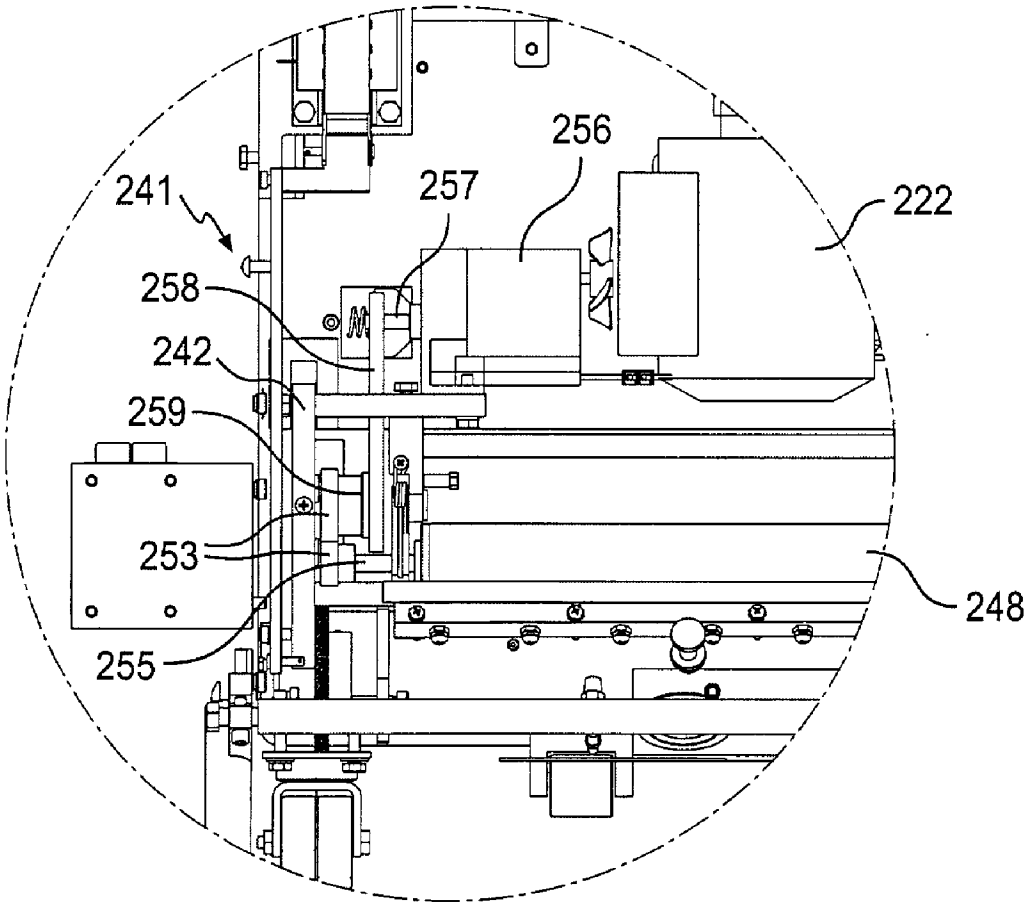
FIG. 5 is a schematic top view of a portion of an exemplary transfer-buffer mount assembly.
Figure 6:
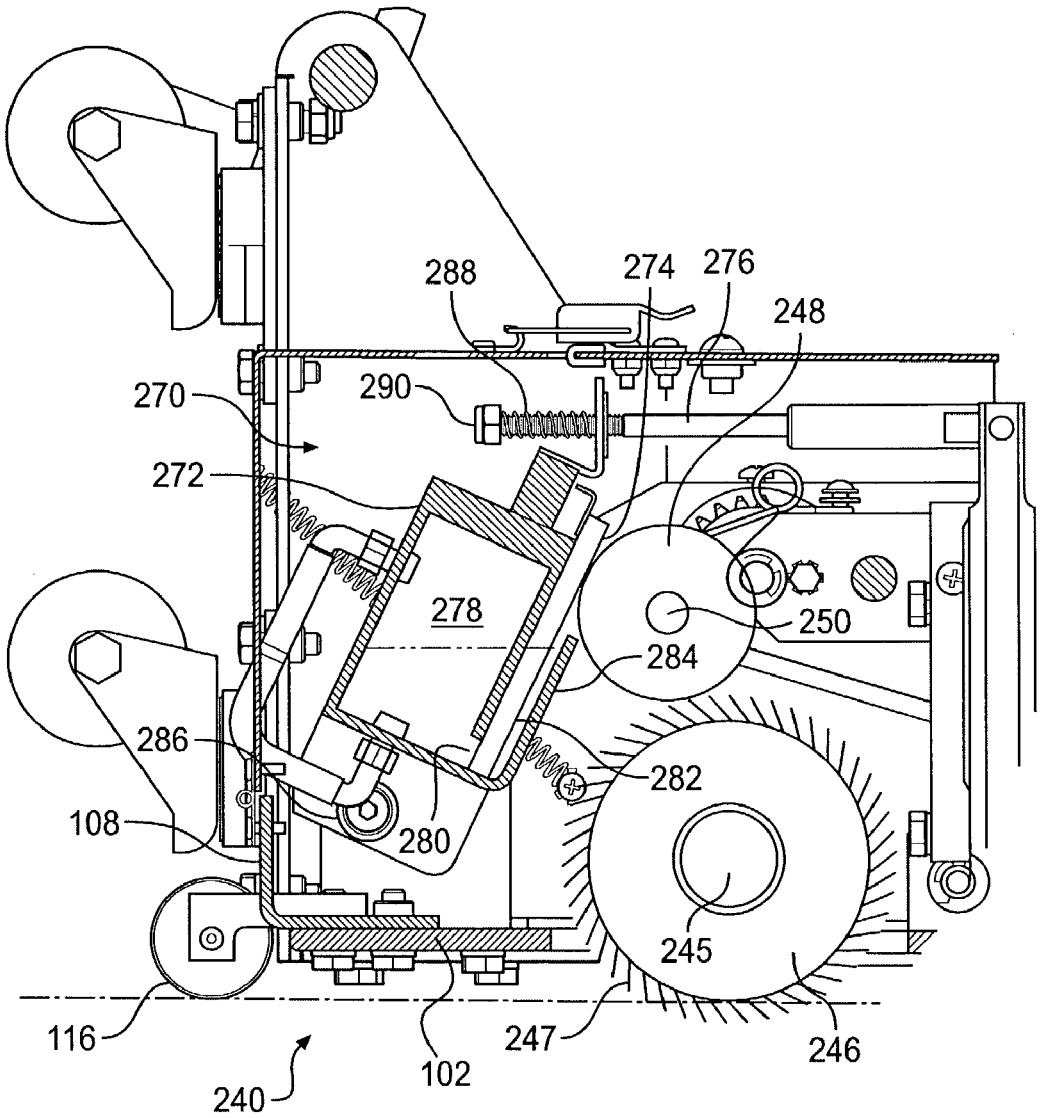
FIG. 6 is a schematic sectional view of an exemplary lane dressing assembly of a bowling lane maintenance apparatus.

FIG. 3 shows a side view of the maintenance apparatus 100 with a side wall of the apparatus frame 102 removed. FIG. 4 shows a sectional side view of the maintenance apparatus 100 in an operating position. FIG. 5 shows a view of a part of a transfer-buffer mount assembly. FIG. 6 shows a cross-section view of a dressing assembly.

With reference to FIGS. 2–6, the maintenance apparatus 100 includes a cleaning assembly 200, a drive assembly 220, and a dressing assembly 240. The cleaning assembly 200 may be provided near the front end 106 of the maintenance apparatus 100, and the dressing assembly 240 may be provided adjacent to the cleaning assembly 200, near the rear end 108. Centrally located within the apparatus frame 102, the drive assembly 220 is fixed, adjacent to the dressing assembly 240.

The cleaning assembly 200 may include a cleaner application assembly 202 and a vacuum assembly 210. The cleaner application assembly 202 includes the cleaner tank 120, a fluid pump 204, fluid tubing 206, and nozzles 208. The fluid tubing 206 connects the cleaner tank 120, the fluid pump 204, and the nozzles 208, to provide fluid flow. The fluid pump 204 may be controlled by control logic at the control panel 126, and may be powered on and off as programmed by an operator. It may be connected in fluid communication with the cleaner tank 120 and may draw cleaner fluid from the cleaner tank 120, in addition to pressurizing the fluid and forcing it through the fluid tubing 206. The pressured fluid sprays from the nozzles 208. In so doing, cleaner fluid is applied directly to the bowling lane surface at the front end 106 of the maintenance apparatus 100. The nozzles 208 may be spaced across the front end 106 to provide a uniform spray of cleaner to the bowling lane. They may also be angled down to prevent cleaner overspray.

The vacuum assembly 210 includes the vacuum hose 122, the waste tank 118, a vacuum motor 212, and a vacuum head 214 (shown in FIG. 4). The vacuum assembly 210 operates to remove the cleaner fluid applied to the bowling lane by the cleaner application assembly 202, as well as any oil, dust, and debris that may be on the bowling lane surface. The vacuum head 214 (shown in FIG. 4) extends along the bottom of the maintenance apparatus 100, and spans substantially the whole width of the maintenance apparatus. An agitation foam 216 extends downward from the vacuum head 214, and contacts the bowling lane surface when the vacuum head 214 is in use. The agitation foam 216 is used to agitate the cleaner fluid on the bowling lane surface so that it mixes with any oil on the lane to allow easier removal of the oil.

A leading squeegee blade 217 and a trailing squeegee blade 218 may be provided on the vacuum head 214. Like the agitation foam 216, the squeegee blades 217, 218 extend downward from the vacuum head, and contact the bowling lane surface when in use. Formed of soft rubber, the squeegee blades 217, 218 slide along the surface of the bowling lane to facilitate removal of the cleaning fluid and other waste by maintaining it under the vacuum head 214 until it is substantially fully removed from the lane by the vacuum assembly 210. The front edge of the leading squeegee blade 217 wipes the lane and directs the cleaning fluid and waste into the vacuum area. The trailing squeegee 218 seals against the lane to create a vacuum chamber between the leading and trailing squeegees 217, 218.

The drive assembly 220 includes a drive motor 222 connected to wheel drive shaft by a belt (not shown) for turning drive wheels 224. The drive motor 222 may operate in both a forward and reverse direction. The drive wheels 224 (FIG. 4) extend through the bottom of the maintenance apparatus 100 and are in contact with the bowling lane surface when the side casters 112 are suspended above the lane gutters. In one exemplary embodiment, two drive wheels 224 are provided for driving the maintenance apparatus 100 down the bowling lane. Alternatively, a single drive wheel or more than two drive wheels may be included on the maintenance apparatus 100.

The dressing assembly 240 includes a transfer-buffer mount assembly 241 and an oil tank assembly 270 (best seen in FIGS. 4 and 6, respectively). The transfer-buffer mount assembly 241 includes a dressing assembly side plate 242 (FIG. 3), a buffer motor 244, a buffer brush 246, a transfer roller 248, and a transfer roller motor 256 (FIG. 5). The buffer brush 246 rotates about a brush axis 245 and may include radially extending bristles 247 that may be used to apply oil to the bowling lane surface. The buffer brush 246 may be, for example, a brush, a foam, a mat, or a nap material, such as, for example, a carpet material, for applying oil to the bowling lane. The buffer brush 246 could be any other known material for applying oil to the bowling lane surface. The transfer roller 248 rotates about a transfer roller axis 250 and may be formed of a stainless steel or other material capable of transferring oil to the buffer brush 246.

The dressing assembly side plate 242 secures all the components of the transfer-buffer mount assembly 241 in place, in addition to spacing the buffer brush 246 and the transfer roller 248 so that the radially extending bristles 247 on the buffing brush 246 have sufficient contact with the surface of the transfer roller 248 to transfer oil from the transfer roller 248 to the bristles 247. Subsequently, the bristles 247 deposit the oil on the bowling lane surface.

In one exemplary embodiment, the buffer brush 246 and the transfer roller 248 each extend substantially the width of the bowling lane, and are substantially parallel to each other. In some embodiments, the buffer brush 246 and/or the transfer roller 248 may be formed of multiple pieces, placed together to extend substantially the width of the bowling lane.

The buffer motor 244 may be an electric motor associated with the control panel 126 to power on and off as programmed by an operator. The buffer motor 244 may drive the buffer brush 246 with a buffer motor belt 254 (FIGS. 2 and 3) extending from an output shaft of the buffer motor 244 to the buffer brush 246.

As best seen in FIG. 5, the transfer roller motor 256, for driving the transfer roller 248, may be also secured in place on the dressing assembly side plate 242. The transfer roller motor 256 may be controlled at the control panel 126 to turn on and off as desired. As best seen in FIG. 5, an output shaft 257 extending from the transfer roller motor 256 drives a chain 258. The chain 258 connects to a sprocket 259 which drives gears 253. The transfer roller 248 includes a gear shaft 255 extending along the transfer roller axis 250 to the gears 253. Accordingly, the transfer roller 248 may be intermittently operated to apply oil as desired.

As best seen in FIG. 3, the transfer-buffer mount assembly 241 may be secured to the frame assembly 102 at a pivot point 266 in the dressing assembly side plate 242. The pivot point 266 may be located in a front corner of the dressing assembly side plate 242, allowing a back end of the dressing assembly side plate 242 to raise and lower. Pivoting the dressing assembly side plate 242 raises and lowers the transfer-buffer mount assembly 241 so that the bristles 247 of the buffer brush 246 may come into and out of contact with the bowling lane surface.

A straight link 260, extending from a solenoid 252 to an L-link 262, may be used to raise and lower the transfer-buffer mount assembly 241. The L-link 262 may connect to a link pivot block 264 at a link pivot point 268. The L-link 262 includes a link slot 263 and slidably receives a slider 265 on the dressing assembly side plate 242. When the solenoid 252 is actuated, the straight link 260 pivots the L-link 262 about the link pivot point 268 to lower the dressing assembly side plate 242 so that the buffer roller 246 is in contact with the bowling lane surface. When not engaged, a return spring may be used to lift the dressing assembly side plate 242 so that the buffer roller 246 is out of contact with the lane.

The oil tank assembly 270 (best seen in FIG. 6) includes an oil tank 272, a wick 274, and an oil tank linkage 276. The oil tank 272 may be secured to the frame assembly 102 by a pivot screw 286. The oil tank 272 includes an interior chamber 278 for holding oil, an opening 280 that allows oil to exit the chamber 278, and a slot 282 formed by a lip 284 extending up along a side of the oil tank 272. The wick 274 is positioned in the slot 282 to pass oil from the tank 272 via capillary flow. The oil tank 272 is mounted to pivot about the pivot screw 286 so that the oil tank 272 may be forced toward the transfer roller 248.

In some embodiments, the maintenance apparatus 100 includes a single oil tank 272 extending substantially the width of the bowling lane. In other embodiments, the maintenance apparatus includes more than one oil tank 272, wherein the oil tanks are optionally aligned with each other. In such multi-tank embodiments, each oil tank 272 may include a slot 282 for receiving one or more wicks 274.

The oil tank linkage 276 extends from a top portion of the oil tank 272 to secure the oil tank 272 in place with respect to the apparatus frame 102. The oil tank linkage 276 may be a threaded rod that includes a spring 288 that is used to bias the oil tank 272 toward the transfer roller 248. A nut 290 on the end of the oil tank linkage 276 may be turned to increase or decrease the force applied by the spring 288. In one exemplary embodiment, the oil tank linkage 276 extends from the top portion of the oil tank 272 to connect to the rear end 108 of the maintenance apparatus 100.

In the embodiment shown in FIG. 6, the oil tank 272 may be biased by the spring 288, so that the wick 274 extending from slot 282 is maintained in contact with the transfer roller 248. The wick 274 is secured between a side of the oil tank 272 and the transfer roller 248. The wick 274 draws oil from the oil tank 272 and applies the oil to the transfer roller 248. The transfer roller 248 receives oil from the wick 274 when the transfer roller 248 is rotated about its axis 250. To stop the deposit of oil to the transfer roller 248, the rotation of the transfer roller 248 is stopped.

In some embodiments, the wick 274 is formed of a material that allows oil to be passed through the wick 274 to the transfer roller 248 by capillary action. One such material is a foam material, for example. In one example, the foam is a reticulated foam. The material may include a substantially uniform capillarity, thereby allowing substantially consistent and substantially precise control of the amount of oil flowing through the wick. Further, the wick 274 may have a substantially uniform density (e.g., as compared to cotton and fibrous felt material of conventional wicks), with a series of substantially the same number of cells per unit area dispersed through the material. The oil flow rate may be affected by the density of the wick, with a denser wick having a lower capillarity, thereby providing a lower flow rate than a less dense wick.

In one embodiment, the wick 274 is a foam wick formed of a polymer, such as, for example, a polyester urethane, a reticulated polyester urethane, a non-reticulated polyester urethane, a non-reticulated polyether, and a reticulated polyether. However, as would be apparent to one skilled in the art, the wick 274 could be formed from any material, especially those that provide substantially uniform wicking properties and substantially uniform flow of oil from the oil tank 272 to the transfer roller 248, for example. Foam wicks having these uniform properties can be obtained from Foamex International Inc., of Linwood, Pa. In one exemplary embodiment, Foamex Product No. 900Z, formed of polyester urethane, and having a thickness of about 0.25 inch, may be used to wick the oil from the oil tank 272 to the transfer roller 248. In other exemplary embodiments, wicks having a firmness in the range of 2 to 20 may be used with the maintenance apparatus 100.

In one exemplary embodiment, a plurality of different wicks 274 having different capillarities are placed side-by-side in the slot 282 of the oil tank 272 and aligned with one another, together extending substantially the width of the bowling lane. Because each wick 274 has a capillarity that provides a predictable flow, the flow rate of oil from the oil tank 272 to the transfer roller 248 can be substantially controlled. Accordingly, by aligning a plurality of wicks across the bowling lane, a desired oil profile can be applied to the transfer roller 248, for subsequent application to the bowling lane by the buffer brush 246.

Because wicks having different capillarities can be placed adjacent to each other in the slot 282, a combination of selected wicks may be used to create a customized profile across the width of the bowling lane, applying oil more heavily on one part of the bowling lane than another. In one embodiment, the wick 274 may be cut-to-fit on site by an operator, and placed within the maintenance apparatus 100, allowing simplified changeover and maximum pattern potential.

Figure 10:
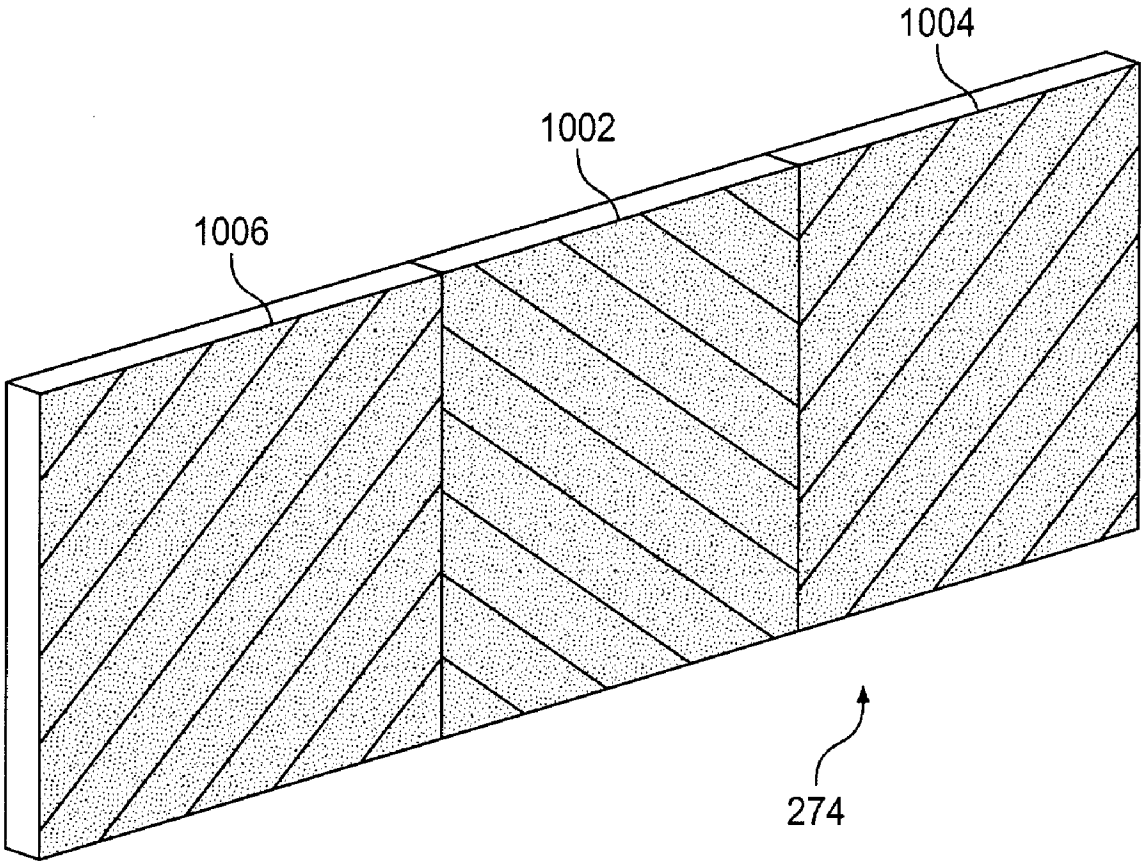
FIG. 10 is a diagram of an exemplary wick with regions of differing capillarities.

In some exemplary embodiments, separate wicks having different capillarities may be used together on the same maintenance apparatus 100. In other exemplary embodiments, the maintenance apparatus 100 may have a single-piece, integral wick, including multiple regions along its length, wherein at least some of the regions have a capillarity differing from one another. One example of such a wick is illustrated in FIG. 10. In FIG. 10, the wick 274 may include a central region 1002 having a first capillarity, and side regions 1004, 1006, adjacent to the central region 1002, having second capillarities differing from the first capillarity. The capillarities of side regions 1004, 1006 may be substantially the same or different from one another. In one exemplary embodiment, the central region may have relatively high capillarity properties and the side regions may have relatively lower capillarity properties. Although FIG. 10 shows the wick 274 having three regions, the wick 274 may have more or less than three regions, and the wick 274 may have more or less than two capillarities. In addition, for certain other alternative embodiments, the wick 274 might have a relatively constant capillarity along its length, without necessarily having regions.

In another exemplary embodiment, one wick having high capillarity properties and two wicks having comparatively low capillarity properties are placed in the slot 282. The low capillarity wicks are placed on each side of the high capillarity wick, and together, substantially span the width of the bowling lane. As such, the high capillarity wick is disposed above the central portion of the lane, and the low capillarity wicks are disposed above the edge portions of the lane. In this embodiment, the wicks may have a common thickness, such as, for example, about 0.25 inch. As the transfer roller 248 rotates, the centrally-located high capillarity wick provides a higher oil flow than the oil flow through the low capillarity wicks. Accordingly, more oil is applied to the central portion of the bowling lane, and therefore, the lane oil profile includes a thicker oil layer on the central portion as compared to the edge portions. Any number of wicks may be provided to create a desired oil profile (e.g., more or less than three wicks may be used to customize the oil profile on the lane). Further, the wicks need not all be associated with the same oil tank. In some exemplary embodiments, more than one tank is provided and one or more wicks may be associated with each tank. Additionally, the oil profile need not be symmetric across the lane, but may include a thicker oil layer on one edge portion as compared to the other edge portion.

In one embodiment, wicks having different capillarities may be designated with a color that represents their respective capillarity. For example, a high capillarity wick may be colored red, while a lower capillarity wick may be colored blue. An operator can then easily identify which wick or wicks to use in the maintenance apparatus 100 to provide the desired oil profile. Any number of colors may be used to identify any number of wicks having different capillarities. In one embodiment, to create an oil profile that complies with American Bowling Congress specifications, five wicks may be used, with a red high capillarity wick in the center, blue medium capillarity wicks adjacent to, and on each side of the blue wick, and green low capillarity wicks adjacent to the blue wicks. Any colors may be used to identify the wicks, as would be apparent to one skilled in the art. Alternatively, symbols or any designation other than color could be used to designate wicks having differing properties. In one embodiment, instructions are provided to the operator explaining specific wick combinations, by capillarity, color, density, or other designation that may be used to create specific oil profiles on the lane.

Returning to FIG. 2, an optical sensor bracket 228 may be secured on the maintenance apparatus 100 and may hold an approach optical sensor 230. The approach optical sensor 230 indicates when the maintenance apparatus 100 has returned from the lane to the approach area. Likewise, a pin-deck optical sensor 236 may be attached at the front end 106 of the maintenance apparatus 100 to signal when the maintenance apparatus 100 reaches the end of the pin deck. Front idler wheels 234 may be provided at a front end of the bowling lane maintenance apparatus 100, as shown in FIG. 2. The front idler wheels 234 may keep the vacuum squeegee and applicator from touching the lane when moving the maintenance apparatus 100 from the lane. As can be seen in FIG. 2, the control panel 126 may be associated with a control panel housing 232.

Figure 9:
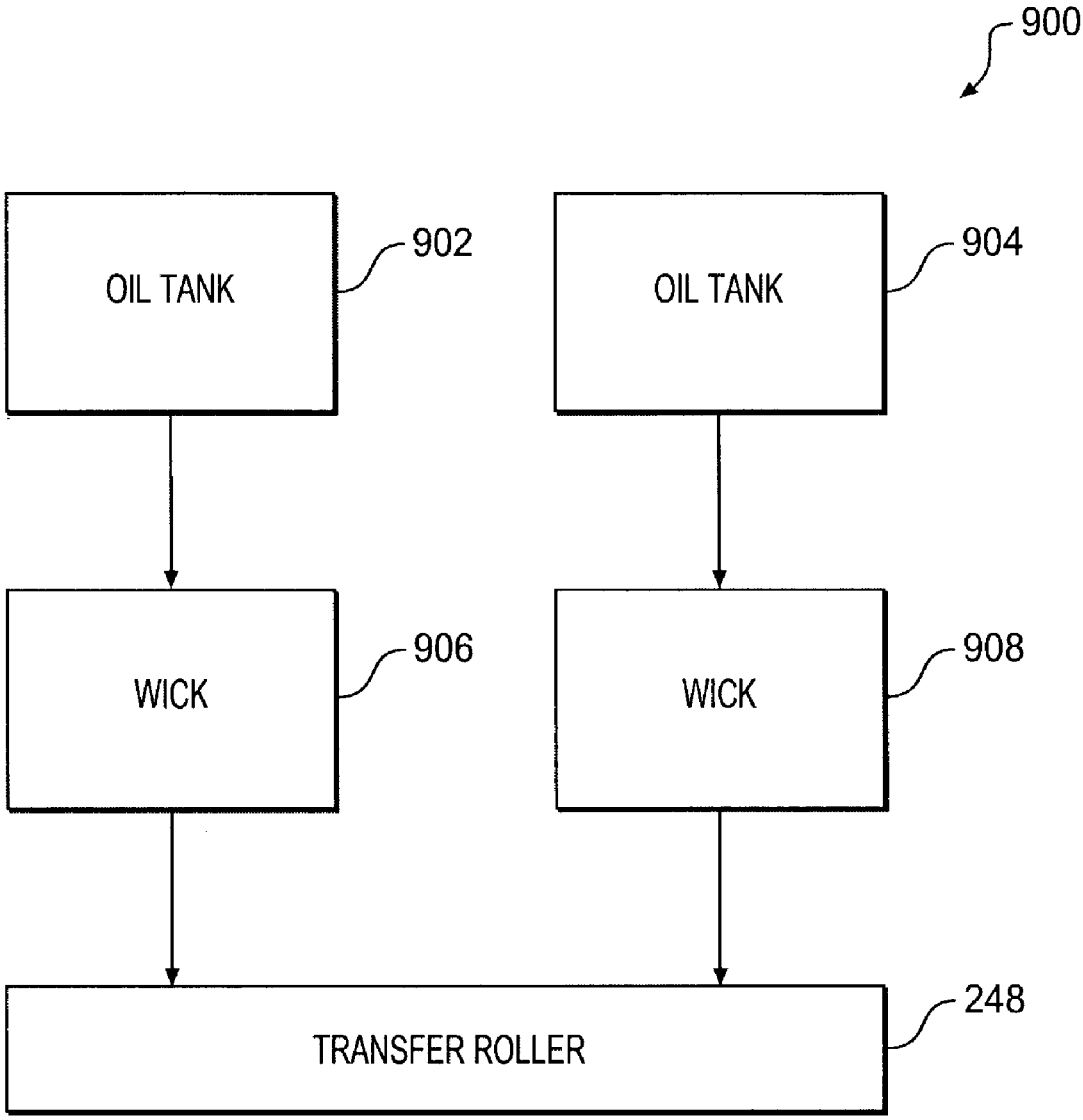
FIG. 9 is a block diagram of an exemplary dressing oil tank assembly of a bowling lane maintenance apparatus.

One example of a multi-tank system for use on the maintenance apparatus 100 is shown as a block diagram in FIG. 9. An exemplary oil tank assembly 900 may include a first dressing oil tank 902 and a second dressing oil tank 904. The first and second dressing oil tanks 902, 904 may have substantially the same features and configuration as the dressing oil tank 272, and, in one embodiment, may be placed adjacent each other in the bowling lane apparatus 100. A first and a second wick 906, 908 are respectively associated with the first and second dressing oil tanks 902, 904. The first and second wicks 906, 908 may configured similar to the wick described with reference to wick 274. The first and second wicks 906, 908 may be associated with the transfer roller 248 of the maintenance apparatus 100. Accordingly, as shown in FIG. 9, more than tank may be used with the bowling lane maintenance apparatus 100. Likewise, more than one wick may be use with each of the first and second dressing oil tanks 902, 904.

Figure 7:
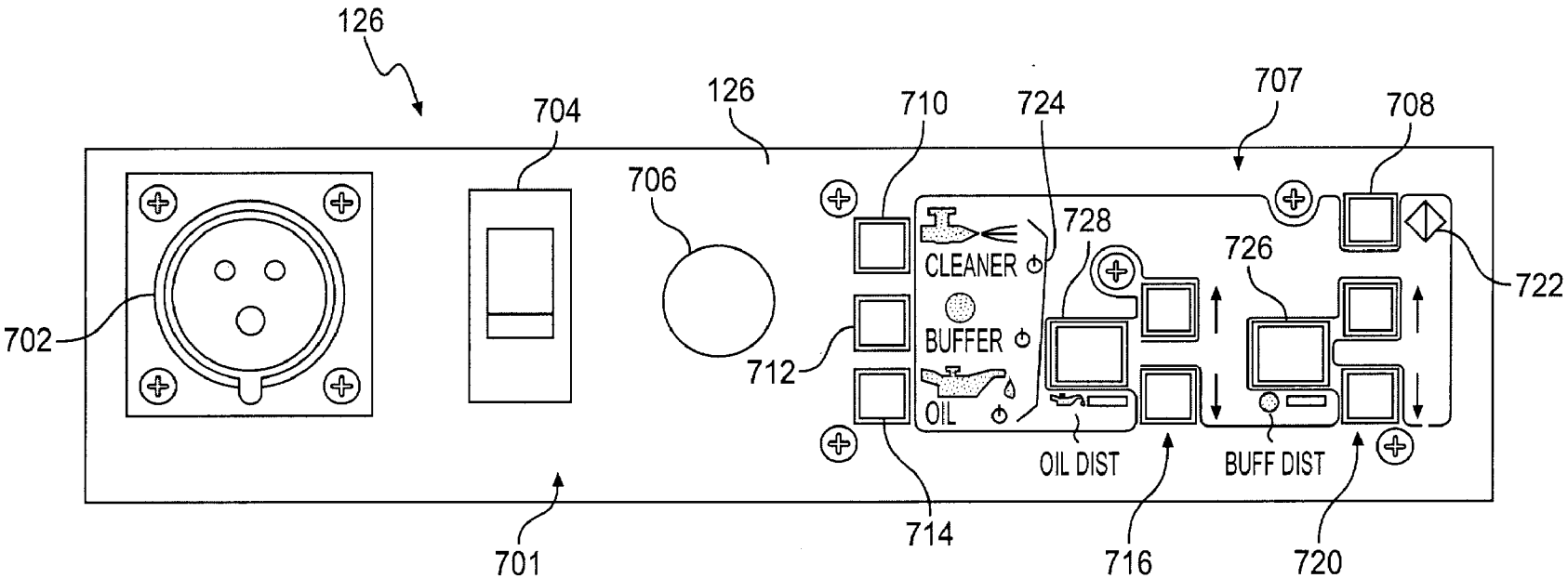
FIG. 7 is a diagram of an exemplary control panel for a bowling lane maintenance apparatus.

FIG. 7 is a schematic of the exemplary control panel 126 for use on the maintenance apparatus 100. The control panel 126 includes power controls 701 and system controls 707. The power controls 701 include a power inlet 702, a power switch 704, and an emergency stop button 706. The system controls 707 include a start button 708, a cleaner button 710, a buffer button 712, and an oil button 714.

The start button 708 starts an operation of cleaning and dressing the bowling lane. In one embodiment, the start button 708 is pressed twice, with the first press activating the components, and the second press, activating the drive motor 222 to propel the maintenance apparatus 100 down the lane. The start button 708 may include a time-out feature, so that if more than a short period of time expires between the first and second times the button is pressed, the start-up sequence halts, and the sequence must begin again. A start indicator 722 identifies the start button 708.

The cleaner button 710, the buffer button 712, and the oil button 714 select and deselect the cleaner operation, buffing operation, and oiling operation, respectively. In one embodiment, the operations are automatically selected upon powering the maintenance apparatus 100, but may be deselected by pressing the appropriate button, if desired. Further, in another embodiment, the buffing operation is automatically selected if the oiling operation is selected. The cleaner button 710, the buffer button 712, and the oil button 714 may be configured to glow when selected. Indicators 724 identify the buttons associated with each function.

Scroll buttons 716 and 720 control when the maintenance apparatus 100 starts and stops oiling, and starts and stops buffing, respectively, and may be configured to glow during operation. The scroll buttons 716 and 720 operate with an oil distance indicator 728 and a buffing distance indicator 726 that display the distance selected by the scroll buttons 716, 720. The buffing distance indicator 726 indicates the distance of the lane in feet (or any other unit of length measurement) from the bowling lane approach area to be buffed. The distance may be increased or decreased by scrolling up or down with the scroll buttons 716. Likewise, the oil distance indicator 728 indicates the distance in feet that the oil will be applied from the approach area. The scroll buttons 716 allow this distance to be increased or decreased.

Figure 8:
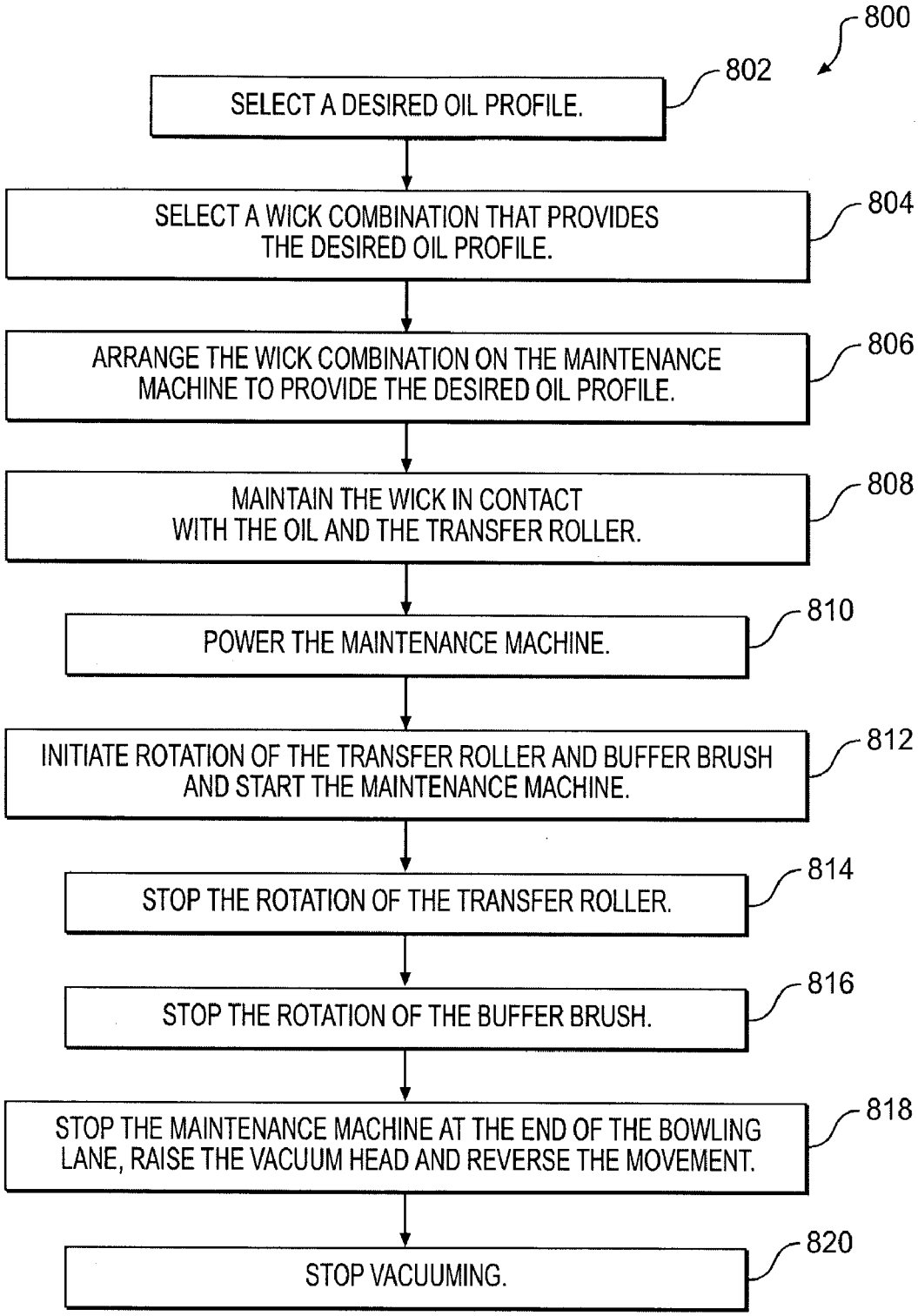
FIG. 8 is a flow chart showing exemplary steps for providing maintenance to a bowling lane.

FIG. 8 describes exemplary operating steps for operating the maintenance apparatus 100 to clean a bowling lane. A flow chart 800 includes an initial step 802 of selecting a desired oil profile. The operator could select the desired oil profile based on American Bowling Congress specifications, or other desired oil profile. Based on the selected oil profile, the operator selects a wick combination that provides the desired oil profile, at a step 804. The wick combination may be provided in instructions that accompany the maintenance apparatus 100, or may be any other custom combination to create the desired oil profile. In one embodiment, selecting the wick combination includes selecting more than one wick 274 to provide the desired oil profile on the lane. In another embodiment, selecting the wick combination may be accomplished by selecting a combination of colored wicks, with each color representing a level of capillarity or flow rate.

At a step 806, the selected wick combination is arranged on the maintenance apparatus 100 to provide the desired oil profile. To arrange the wick combination, the wicks 274 are placed in the slot 282 of the oil tank 272 so that they draw oil to create the desired oil profile. The arrangement may be provided in instructions, explaining a wick color arrangement or a wick capillarity or density arrangement. Oil may be added to the oil tank 272 if the tank indicator shows that the tank is low on oil.

At a step 808, the wick 274 is placed in contact with the oil in the oil tank 272 and the transfer roller 248 by the oil tank linkage 276, and maintained in contact with the transfer roller. At a step 810, the maintenance apparatus 100 is powered on, and the oil distance and buffing distance indicated on the indicators 726, 728 are verified, and adjusted, if necessary.

At a step 812, rotation of the transfer roller 248 and buffer brush 246 is initiated. Because the transfer roller 248 is in contact with the wick 274, oil transfer begins when the transfer roller 248 begins turning. The rotation of the transfer roller 248 and buffer brush 246 is initiated by pressing the start button 708 on the control panel 126 or the handle start button 128 on the handle 104. Depending on the settings on the control panel 126, pressing the start button 708 or the handle start button 128 a first time powers the fluid pump 204 to spray cleaner solution, the vacuum head 214 drops down, and the vacuum motor 212 starts. Pressing one of the start buttons 708, 128 a second time starts the buffing and oil operations (if selected) and the drive motor 222. Accordingly, the maintenance apparatus 100 begins moving down the bowling lane.

The transfer roller 248 rotates until the maintenance apparatus 100 has traveled the distance indicated on the oil distance indicator 728. Then, to stop the transfer of oil, rotation of the transfer roller 248 is stopped, at a step 814. However, the wick 274 is maintained in contact with the transfer roller 248. The buffer brush 246 may continue to rotate until the maintenance apparatus 100 travels the distance indicated on the buffing distance indicator 726. Continued rotation of the buffer brush 246 allows the oil accumulated on the bristles 247 of the buffer brush 246 to be applied to the lane. Accordingly, the oil layer tapers down the bowling lane between the distance on the oil distance indicator and the distance on the buffing distance indicator. At a step 816, rotation of the buffer brush 246 is stopped and the buffer brush 246 is raised out of contact with the bowling lane surface by disengaging the solenoid(s) 252 to rotate the dressing assembly side plate 242 about the pivot point 266.

The maintenance apparatus 100 continues down the lane until the pin deck optical sensor senses that the end of the lane is reached. At this point, the cleaning spray is stopped, the maintenance apparatus 100 stops moving, the vacuum head 214 is raised from the lane, and the apparatus reverses to travel back toward the approach area, at a step 818. In one embodiment, the vacuum motor 212 continues to operate during the reverse movement until the maintenance apparatus 100 is about 10 feet from the end of the bowling lane. Then, the vacuum motor 212 stops, while the maintenance apparatus 100 continues in reverse to the approach area. In one embodiment, the buffing and oiling may be activated in reverse order as the maintenance apparatus 100 returns from the pin deck.

In one embodiment, wicks having equal thickness but different densities can be used side by side in the same tank to provide varied flow to the transfer roller, while being held in contact with the transfer roller for an equal length of time. Accordingly, with only a single tank, the wicks may be used to create an oil profile on the lane that varies across the width of the lane. As discussed above, alternative arrangements including more than one tank are also possible.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A bowling lane maintenance apparatus, comprising:
- a transfer roller;
- a dressing oil tank configured to contain dressing oil;
- a wick configured to pass dressing oil from the tank to the transfer roller; and
- a buffer brush configured to receive dressing oil from the transfer roller and spread the dressing oil on a bowling lane,
- wherein the wick comprises a foam material having a first region comprising a first capillarity and a second region having a second capillarity differing from the first capillarity.

2. The bowling lane maintenance apparatus of claim 1, wherein the foam wick is formed of one of a polyester urethane, a reticulated polyester urethane, a non-reticulated polyester urethane, a non-reticulated polyether, and a reticulated polyether.

3. The bowling lane maintenance apparatus of claim 1, wherein the wick is configured to pass dressing oil onto the transfer roller so as to provide a desired dressing oil profile on the bowling lane.

4. The bowling lane maintenance apparatus of claim 1, further comprising:
- a cleaning assembly configured to apply cleaner to the bowling lane and remove the cleaner applied to the bowling lane.

5. The bowling lane maintenance apparatus of claim 1, wherein the wick comprises a first wick and wherein the apparatus further comprises:
- a second dressing oil tank; and
- a second wick configured to pass dressing oil from the second dressing oil tank to the transfer roller, the second wick having a capillarity differing from the capillarity of the first wick.

6. The bowling lane maintenance apparatus of claim 1, wherein the apparatus is configured such that the wick is maintained in contact with the transfer roller.

7. A bowling lane maintenance apparatus, comprising:
- a transfer roller;
- a dressing oil tank configured to contain dressing oil;
- at least two wicks configured to pass dressing oil from the tank to the transfer roller, the at least two wicks having a differing capillarity; and
- a buffer brush configured to receive dressing oil from the transfer roller and spread the dressing oil on a bowling lane,
- wherein the apparatus is configured such that the at least two wicks are maintained in contact with the transfer roller.

8. The bowling lane maintenance apparatus of claim 7, wherein the at least two wicks are foam wicks.

9. The bowling lane maintenance apparatus of claim 8, wherein the foam wicks are formed of at least one of a polyester urethane, a reticulated polyester urethane, a non-reticulated polyester urethane, a non-reticulated polyether, and a reticulated polyether.

10. The bowling lane maintenance apparatus of claim 7, wherein each of the at least two wicks includes a designation representing a respective capillarity.

11. The bowling lane maintenance apparatus of claim 10, wherein the designation is a color representing a respective capillarity.

12. The bowling lane maintenance apparatus of claim 7, wherein the at least two wicks are configured to pass dressing oil onto the transfer roller so as to provide a desired dressing oil profile on the bowling lane.

13. The bowling lane maintenance apparatus of claim 7, further comprising:

a cleaning assembly configured to apply cleaner to the bowling lane and remove the cleaner applied to the bowling lane.

14. The bowling lane maintenance apparatus of claim 7, wherein the at least two wicks comprise a first wick and a second wick and wherein the apparatus further comprises:

a second dressing oil tank, wherein the second wick is configured to pass dressing oil from the second dressing oil tank to the transfer roller.

15. A bowling lane maintenance apparatus, comprising:

a transfer roller;

at least one dressing oil tank configured to contain dressing oil;

at least two wicks configured to pass dressing oil from the at least one dressing oil tank to the transfer roller; and a buffer brush configured to receive dressing oil from the transfer roller and spread the dressing oil on a bowling lane, wherein the at least two wicks have a differing capillarity.

16. The bowling lane maintenance apparatus of claim 15, wherein the at least one dressing oil tank is a single dressing oil tank.

17. The bowling lane maintenance apparatus of claim 15, wherein the at least one dressing oil tank comprises a plurality of dressing oil tanks, and wherein each of the at least two wicks is associated with a different one of dressing oil tanks.

18. The bowling lane maintenance apparatus of claim 15, wherein the at least two wicks are foam wicks.

19. The bowling lane maintenance apparatus of claim 15, wherein the foam wicks are formed of at least one of a polyester urethane, a reticulated polyester urethane, a non-reticulated polyester urethane, a non-reticulated polyether, and a reticulated polyether.

20. The bowling lane maintenance apparatus of claim 15, wherein each of the at least two wicks includes a designation representing a respective capillarity.

21. The bowling lane maintenance apparatus of claim 20, wherein the designation is a color representing a respective capillarity.

22. The bowling lane maintenance apparatus of claim 15, wherein the at least two wicks are configured to pass dressing oil onto the transfer roller so as to provide a desired dressing oil profile on the bowling lane.

23. The bowling lane maintenance apparatus of claim 15, further comprising:

a cleaning assembly configured to apply cleaner to the bowling lane and remove the cleaner applied to the bowling lane.

24. The bowling lane maintenance apparatus of claim 15, wherein the apparatus is configured such that the at least two wicks are maintained in contact with the transfer roller.

* * * * *